US006301870B1

(12) United States Patent
Bünger et al.

(10) Patent No.: US 6,301,870 B1
(45) Date of Patent: Oct. 16, 2001

(54) FALSE TWIST TEXTURING MACHINE AND METHOD FOR PRODUCING A TEXTURED THREAD

(75) Inventors: Heino Bünger, Radevormwald; Hellmut Lorenz, Remscheid, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/284,739

(22) PCT Filed: Aug. 10, 1998

(86) PCT No.: PCT/EP98/05067

§ 371 Date: Aug. 19, 1999

§ 102(e) Date: Aug. 19, 1999

(87) PCT Pub. No.: WO99/09239

PCT Pub. Date: Feb. 25, 1999

(30) Foreign Application Priority Data

Aug. 20, 1997 (DE) ..... 197 36 227
Mar. 9, 1998 (DE) ..... 198 10 080

(51) Int. Cl.[7] ..... D01H 7/92

(52) U.S. Cl. ..... 57/290; 57/5; 57/239; 57/328; 57/333

(58) Field of Search ..... 57/5, 239, 290, 57/328, 333; 264/103

(56) References Cited

U.S. PATENT DOCUMENTS

| | | | | |
|---|---|---|---|---|
| 4,180,968 | * | 1/1980 | White | 57/239 |
| 4,362,011 | | 12/1982 | Syuichi . | |
| 4,497,167 | * | 2/1985 | Nakahara et al. | 57/328 |
| 4,905,468 | | 3/1990 | Tanae et al. . | |
| 5,148,666 | | 9/1992 | Bauer et al. . | |
| 5,407,620 | * | 4/1995 | Burchette et al. | 264/103 |
| 5,644,908 | | 7/1997 | Schippers et al. . | |
| 5,794,429 | | 8/1998 | Overstrass et al. . | |

FOREIGN PATENT DOCUMENTS

| | | | |
|---|---|---|---|
| 330368 | * | 8/1989 | (EP) . |
| 0 532 458 | | 3/1993 | (EP) . |

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A false twist texturing machine for the texturing of synthetic threads in one handling position at a time, in which a heating device and a false twist unit are disposed within a false twist zone. In an after-treatment zone are disposed a second heating device and a counter-twist apparatus. In this case a residual twist left in the thread from the false twist unit is removed by the counter-twist apparatus. The counter-twist apparatus is for this disposed in one plane with the second heating device, so that the thread is run substantially in a straight thread path.

3 Claims, 5 Drawing Sheets

FALSE TWIST TEXTURING MACHINE AND METHOD FOR PRODUCING A TEXTURED THREAD

BACKGROUND OF THE INVENTION

The invention relates to a false twist texturing machine for texturing a multiplicity of thermoplastic threads together with a process for producing a textured thread.

A false twist texturing machine of this kind is known from U.S. Pat. No. 5,644,908. In this false twist texturing machine a thread is drawn off from a feeding spool by means of a first delivery device and run in a false twist zone. In the false twist zone are disposed a heating device, a cooling device and a false twist unit. Within the false twist zone a drawing and fixing of the thread takes place. The false twist unit produces a twist which runs in the opposite direction to that of the thread, so that within the cooling device and the heating device, in which a thermal treatment of the thread takes place, the latter exhibits a twist. The thread is after the false twist unit drawn off by a second delivery device and run to a second heating device for the thermal after-treatment. The thread is then run-out of the second heating device by means of a third delivery device and conveyed to a take-up device in which the thread is wound onto a spool. In order to wind on as twist-free a thread as possible, there is provided with the known false twist texturing machine between the third delivery device and the take-up device a vortexing nozzle. In so doing the residual twist contained in the thread is eliminated.

There is known through EP 0 532 458 B1 a false twist texturing machine in which a thread is fed to a false twist zone. In the false twist zone are disposed a first heating device and a false twist unit. The false twist unit produces a twist which runs in the opposite direction to that of the thread. The thread is after the false twist unit run to a second heating device. Downstream of the second heating device is connected a blow nozzle which again imparts a false twist to the yarn, namely in a direction which is opposite to that of the twist produced in the false twist unit.

The problem is encountered with swiftly running threads, however, that the amount of the residual twist increases with the thread speed. In this case the residual twist is imprinted in the thread by the relaxation treatment which has taken place in the second heating device, and it cannot be removed by vortexing.

The present invention is based on the object of developing the false twist texturing machine of the type described above and the process in such a way that the thread is coilable twist-free irrespective of the thread speed.

SUMMARY OF THE INVENTION

The above and other objects and advantages of the invention are achieved by the provision of a yarn false twist texturing machine for texturing a multifilament synthetic thread or yarn comprising a yarn feeding spool, a first delivery device, a first heating device, a cooling device, a false twist unit, a second delivery device, a second heating device, a third delivery device, and a winding device serially arranged along a yarn path of travel. A yarn counter-twist device is positioned between the second heating device and the third delivery device for imparting twist to the yarn in a direction opposite to that imparted by the false twist unit and such that the counter-twist device and the second heating device are linearly aligned and the yarn runs in a straight yarn path therebetween, and so as to produce an essentially twist-free yarn.

The invention is characterised in that the counter-twist in the opposite direction produced by the counter-twist apparatus can run back unimpeded into the second heating device in the opposite direction to that of the thread, i.e. yarn. For this the counter-twist apparatus is arranged in the thread path upstream of the third delivery unit in such a way that the counter-twist apparatus and the second heating device lie in one plane. The thread is thus run in a straight thread path between the heating device and the counter-twist apparatus. The counter-twist produced returns undiminished in the opposite direction to that of the thread until it reaches the second delivery device. It is thus ensured that the thread is already twist-free during the heat treatment for the relaxation. A fixing of a residual twist caused by the false twist unit is prevented. The counter-twist apparatus can in this case produce in the thread a counter-twist by friction, for example by means of discs or straps on the running thread. Since the counter-twist apparatus has to apply a substantially smaller torque to the thread compared with the false twist unit, the counter-twist could also be formed by a roller overrunning obliquely from the thread.

In a particularly advantageous development of the invention, the counter-twist apparatus is arranged directly at the outlet of the second heating device. The counter-twist is consequently introduced in the heated thread. In the heated state the thread possesses a higher elasticity, so that the introduction of the counter-twist is possible with less expenditure of energy.

The construction of the counter-twist apparatus as a vortexing nozzle is particularly preferably applicable here, since as a result of the tangential entering of the air current into a thread channel, first of all, the counter-twist is produced in the thread, and secondly a cooling of the thread is simultaneously effected. A further advantage of this construction of the false twist texturing machine according to the invention lies in the fact that the texturing and hence the bulkiness of the thread is supported by the vortexing of the filaments of the yarn.

According to a particularly advantageous development of the false twist texturing machine the vortexing nozzle is arranged together with a thread channel on an axis of a heating tube of the second heating device. The thread can as a result be inserted without difficulty simultaneously in the heater and in the vortexing nozzle.

With the false twist texturing machine a so-called Z twist or an S twist can be produced in the thread by means of the false twist texturing unit. For this the direction of rotation in the false twist unit is modified. In order to use the vortexing nozzle arranged at the outlet side of the second heating device both for the Z twist and for the S twist, the vortexing nozzle is connected to the heating tube of the heating device by a detachable adaptor. The vortexing nozzle is symmetrical with respect to a center plane lying at right angles to the thread channel, so that a reversal of the direction of rotation is possible by transposing the inlet and outlet sides of the vortexing nozzle.

According to yet another advantageous development of the false twist texturing machine it is proposed that the counter-twist apparatus comprises a substantially rotationally symmetrical, rotatable body, via which the thread is run at an angle $\alpha$, wherein the angle $\alpha$ enclosed by the thread and a normal lying perpendicular on an axis of the body is less than 90°. A regular and reliable introduction of a counter-twist into the thread is obtained by means of such a counter-twist apparatus.

The counter-twist apparatus comprises preferably a cylindrical, rotatable body, via which the thread is conveyed at an angle. With advantage the angle is adjustable. The adjustment takes place preferably by swivelling the axis of the body of the counter-twist imparter.

According to a further advantageous development of the false twist texturing machine it is proposed that the body of the counter-twist apparatus is durable.

The process according to the invention for producing a textured thread is characterised by the fact that the counter-twist is produced in the heated thread directly at the outlet of the second heating zone. The residual twist in the thread can be removed completely in this way, so that a completely twist-free thread can be fed to the winding stage and be wound up. Moreover, the counter-twist can by virtue of the higher elasticity be introduced into the thread in a simple manner without substantial energy supply and hence without substantial modification of the yarn properties, such as for example the bulkiness. Since the counter-twist is produced directly at the outlet of the second heating zone, it can be transmitted undiminished into the heating device and be fixed in the latter.

A particularly advantageous process variant provides that the thread is twisted by a cold air flow flowing eccentrically into a thread channel at right angles to the thread running direction. The thread is therefore cooled directly after leaving the heater, which improves the fixing of the counter-twist and hence the freedom from twist of the thread.

According to a further development of the process it is proposed that after a thread has passed through a thermal treatment and a false twist imparter the thread passes through a counter-twist apparatus, wherein the thread is passed via a substantially rotationally symmetrical, rotatable body at an angle $\alpha$, wherein the angle enclosed by the thread and a normal lying perpendicular on an axis of the body is less than 90°. It is ensured by said process operation that a sufficient counter-twist is introduced into the thread at all times, so that the thread is substantially twist-free downstream of the counter-twist apparatus. The production of the counter-twist takes place substantially mechanically. A better regularity of the counter-twist is also achieved.

Preferably the thread is passed via a cylindrical, rotatable body of the counter-twist apparatus. With this process operation a counter-twist is produced in the thread with relatively simple means. Furthermore, the angle at which the thread overruns the body of the counter-torsion apparatus is preferably controllable, so that an adjustment of the counter-twist apparatus to the counter-twist imparter or to the residual twist of the thread can take place.

According to a further advantageous development of the process it is proposed that the body of the counter-twist apparatus be driven. A friction between the body and the thread running on the body is diminished by a driven body. If the frictional influence of the body of the counter-twist apparatus can be disregarded, the body can also be without a compulsory drive.

BRIEF DESCRIPTION OF THE DRAWINGS

Some embodiments will be described in detail below with reference to the attached drawings, where.

DETAILED DESCRIPTION OF THE PREFERRED EMBODIMENTS

In the following embodiments of the false twist texturing machine according to the invention/the components with the same function are provided with identical reference symbols.

Figure 1:
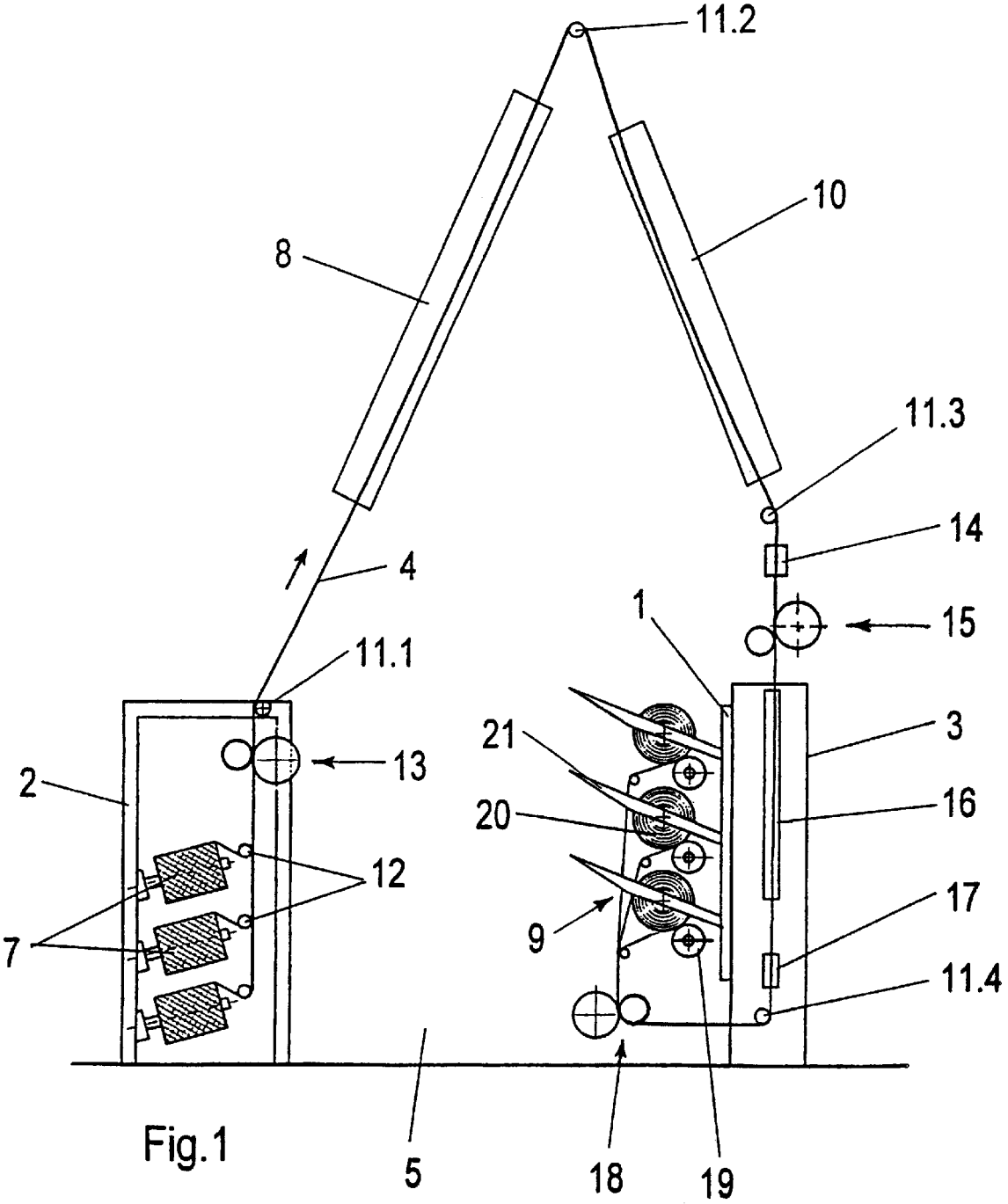
FIG. 1 represents diagrammatically an embodiment of a false twist texturing machine according to the invention, FIG. 2 diagrammatically a further embodiment of a false twist texturing machine according to the invention, FIG. 3 an embodiment of a counter-twist apparatus at the heater outlet, FIG. 4 a cross-section through the vortexing nozzle from FIG. 3, FIG. 5 a still further embodiment of a false twist texturing machine according to the invention and FIG. 6 an embodiment of a counter-twist apparatus.

FIG. 1 shows a first embodiment of a false twist texturing machine. The false twist texturing machine comprises in the longitudinal direction (in the figures the drawing plane is equal to the cross-sectional plane) a multiplicity of handling points, wherein one thread is handled per handling point in each case. Since the winding devices occupy a width of three handling points, three winding devices 9 are arranged one above the other in a column at the winding frame 1 in each case. Similarly three feeding spools 7 are also arranged one above the other in a creeling frame 2.

Each handling point comprises a feeding spool 7, on each of which a thermoplastic thread 4 is wound. The thread 4 is drawn through a top thread guide 12 under a certain tension by the first delivery device 13. The thread running direction is indicated here by an arrow. The thread 4 is then run into a false twist zone by a deflecting roll 11.1.

In the false twist zone the thread 4 runs first of all through a first linear heating device 8. The thread 4 is heated to a particular temperature in the first heating device 8. The first heating device could be constructed in this case for example as a high-temperature heater, with which a surface temperature lies above 310° C. The thread 4 is here run at a short distance above the heating surface. A heating deduce of this kind is known for example from U.S. Pat. No. 5,148,666. Reference is accordingly made to this patent.

Downstream of the first heating device 8 is located a cooling device 10. The cooling device 10 is constructed as a linear cooling section. Between the first heating device 8 and the cooling device 10 the thread is passed over a deflecting roll 11.2, so that the first heating device 8 and the cooling device 10 are arranged in a V shape relative to each other.

The texturing machine according to the invention is not limited however to an arrangement of this kind, but also allows any other relationship between the first heating device and the cooling device, for example in order to obtain a straight thread path, as described later.

Downstream of the cooling device 10 is located a diagrammatically represented false twist unit 14. Said false twist unit 14 can be constructed as a friction disc unit, as is described for example in U.S. Pat. No. 5,794,429. The false twist unit 14 represents the end of the false twist zone.

The false twist unit 14 serves to produce a so-called false twist in the thread 4. Said false twist is transmitted back within the false twist zone to the first delivery device 13. In so doing the false twist passes through the first heating device 8. Within the first heating device 8 there takes place a fixing of the false twist in the filaments of the thread 4 as well as a drawing of the thread. A texturing of the thread is achieved in this way. Between the cooling device 10 and the false twist unit 14 the thread 4 is deflected by means of a deflecting roll 11.3.

After the false twist unit 14 a second delivery device 15 serves to draw the thread 4 both through the heating device 8 and through the cooling device 10. In the thread running direction downstream of the second delivery device 15 is located a second heating device 16. Said second heating device 16 can be constructed as a heating tube, which is surrounded by a heating jacket, wherein the heating tube is heated from the outside with steam to a particular temperature. The second heating device 16 could however also be constructed as a high-temperature heater like the first heating device 8.

At the outlet side of the second heating device 16 is connected a counter-twist apparatus 17, wherein the second heating device 16 and the counter-twist apparatus 17 are arranged in one plane, so that the thread 4 does not undergo deflection of any kind between the second heating device 16 and the counter-twist apparatus 17. The thread 4 is here drawn by means of a further third delivery device 18 out of the second heating device 16 through the counter-twist apparatus 17 and conveyed to a winding device 9. Between the counter-twist apparatus 17 and the third delivery device 18 the thread is deflected by means of the deflecting roll 11.4.

In the winding device 9 the thread 4 is wound on a winding spool 20 which is driven by a friction roll 19. Upstream of the friction roll 19 is located a traversing device, by means of which the thread 4 is run to and fro on the winding spool 20 and is wound onto the latter as a cross winding. The spool 20 is fixed to a spool holder 21. The spool holder 21 is here arranged so as to be pivotable with respect to the winding frame 1.

In the embodiment shown in FIG. 1 the thread 4 is drawn off from the feeding spool 7 with the first delivery device 13 and conveyed into the false twist zone. The false twist is introduced into the thread 4 by the false twist unit 14. The false twist so produced runs back against the thread running direction to the first delivery device or to the deflecting roll 11.1, which could be constructed as a twist stop roll. The thread is therefore run through the heating device 8 and the cooling device 10 in the false-twisted state. The thread 4 is drawn and fixed in the heating device 8 in the twisted state, which leads to a strong imprinting of the twist and hence to a good crimp result in the thread 4.

After the thread 4 has left the false twist zone, the thread 4 possesses a residual twist. A residual twist of this kind, which leads to the distortion of the thread, is however undesirable for subsequent treatment processes. The thread therefore receives in the counter-twist apparatus 17 a counter-twist whose direction of rotation is opposite to the direction of rotation of the false twist. The counter-twist is transmitted back to the second delivery device 15. Since the counter-twist counteracts the residual twist, the fixing and the relaxation treatment of the thread in the second heating device 16 leads to an essentially twist-free thread. It could also be of advantage in this case for an additional delivery device to be positioned before the inlet of the second heating device 16, so that an adjustment of the conveying speeds (afterwind) becomes possible in the after-treatment zone, which is independent of the conveying speed setting of the delivery device of the false twist zone. After the thermal after-treatment the thread 4 is wound onto a cross-wound bobbin 20 of the winding device 9.

When the spools 20 are fully wound, the changing of the spools in the false twist texturing machine is undertaken by means of a doffer (not shown). The doffer moves forward in the control aisle 5 for this. The spool change is then carried out on the machine by several handling devices on the doffer.

Figure 2:
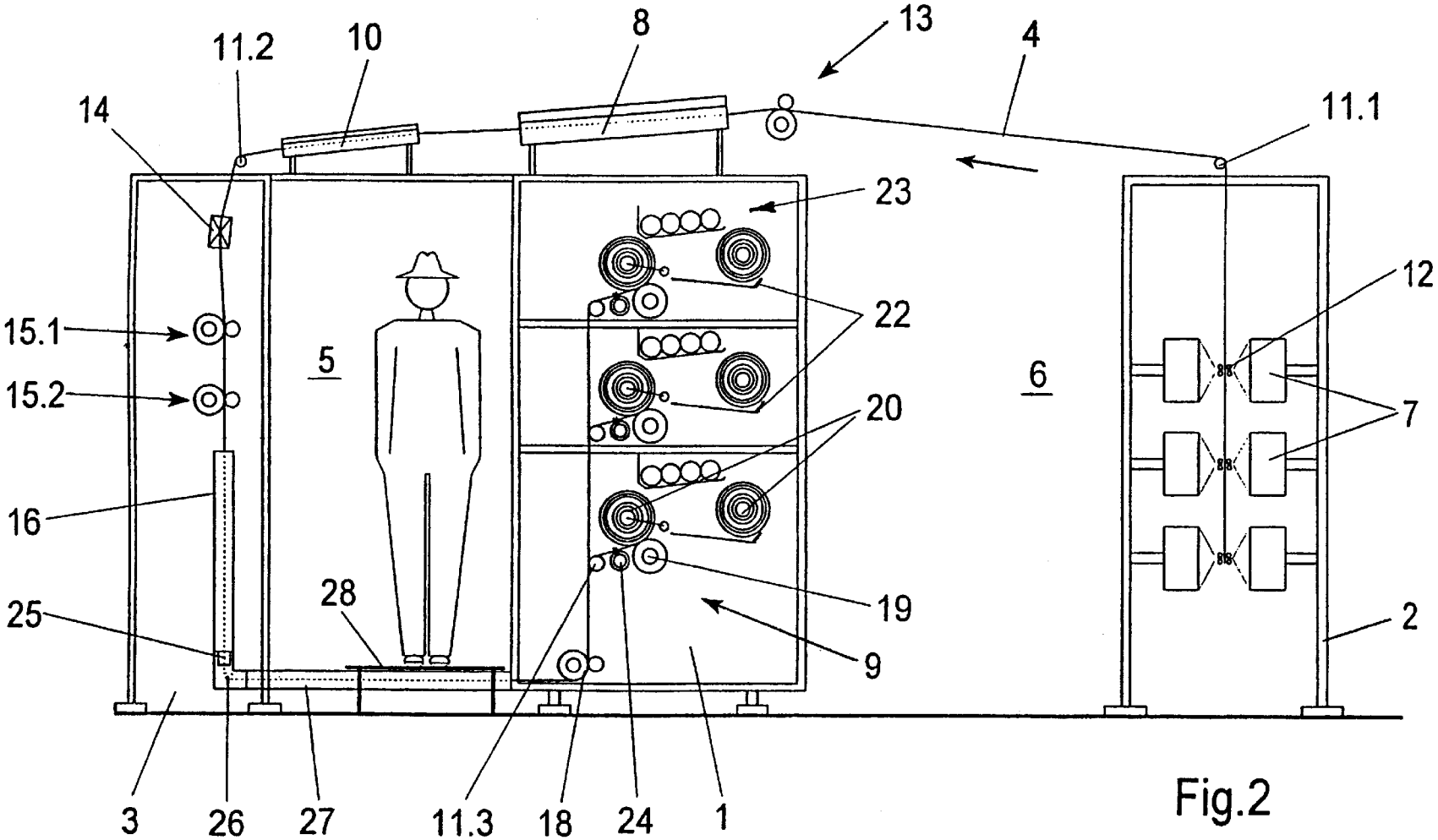

FIG. 2 shows a further embodiment of a false twist texturing machine. The false twist texturing machine likewise consists of a creeling frame 2, a process frame 3 and a winding frame 1. Between the process frame 3 and the winding frame 1 a control aisle 5 is formed. On the side of the winding frame 1 which lies opposite the control aisle 5 is disposed, at a distance from the winding frame 1, the creeling frame 2. A doffing aisle 6 is thus formed between the winding frame 1 and the creeling frame 2.

In the winding frame are disposed one above the other three winding devices 9, which each pertain to a handling point of the machine. In each handling machine the thread 4 is drawn off from a feeding spool 7 disposed in the creeling frame 2 via a top thread guide 12 by a first delivery device 13. The thread is then conveyed by the first delivery device 13 into the false twist zone, which comprises a heating device 8, a cooling device 10 and a false twist unit 14.

The thread 4 is then drawn out of the false twist zone by a second delivery device 15.1. A further delivery device 15.2 is combined with the second delivery device 15.1. directly before the inlet of a second heating device 16. The additional delivery device 15.2 conveys the thread into the after-treatment zone. In this case the speed of the thread 4 is set by the third delivery device 18 positioned at the outlet side of the after-treatment zone. The third delivery device then runs the thread 4 to the winding device 9.

In the winding device 9 the thread 4 is wound onto a winding spool 29, which is driven at the periphery by a friction roll 19. Upstream of the friction roll 19 is located a traversing apparatus 24, by means of which the thread 4 is run to and fro on the winding spool 20 and wound onto the latter as a cross-wound bobbin. The winding device 9 comprises a spool store 22 which serves to receive the full spool when a full winding spool 20 has been produced on the winding device. In order to receive the full spool 20, the spindle support is pivoted and the full spool deposited on a take-off track. The take-off track is part of the spool store 22. The full spool 20 waits on the take-off track until it is removed.

Consequently the take-off track of the spool store 22 is arranged on the side of the winding frame 1 which is adjacent to the doffing aisle 6 and faces away from the control aisle 5. The doffing aisle 6 extends along the winding frame 1 and is formed between the creeling frame 2 and the winding frame 1. It serves to remove the full spools which are waiting on the spool store 22. There is further assigned to each winding device 9 a tube feed device 23, which will not be described in detail. A tube store is involved, on which several empty tubes are stored temporarily. When a winding device 9 produces a full spool on the spindle support and the full spool has been deposited on the spool store, an empty tube is fed to the spindle support in each case and secured to it.

In the after-treatment zone shown in FIG. 2 there is connected downstream of the second heating device 16, directly at the outlet, a vortexing nozzle 25. The vortexing nozzle 25 is constructed here as a counter-twist device which imparts a twist to the thread by means of an air current introduced tangentially into a thread channel. The vortexing nozzle 25 is secured to the second heating device 16 by means of an adaptor 26. On the side of the adaptor 26 which faces away from the second heating device 16 is disposed a compensating tube 27. The thread 4 is here deflected within the adaptor 26 by a thread guide, so that the thread is run through the compensating tube 27 up to the third delivery device 18. The compensating tube 27 is disposed below a platform 28. The platform 28 defines the floor of the control aisle 5. The control aisle 5 is formed between the process frame 3 and the winding frame 1.

In the after-treatment zone shown in FIG. 2 the thread is handled as already described for FIG. 1. Reference is therefore made at this point to the description for FIG. 1.

Figure 3:
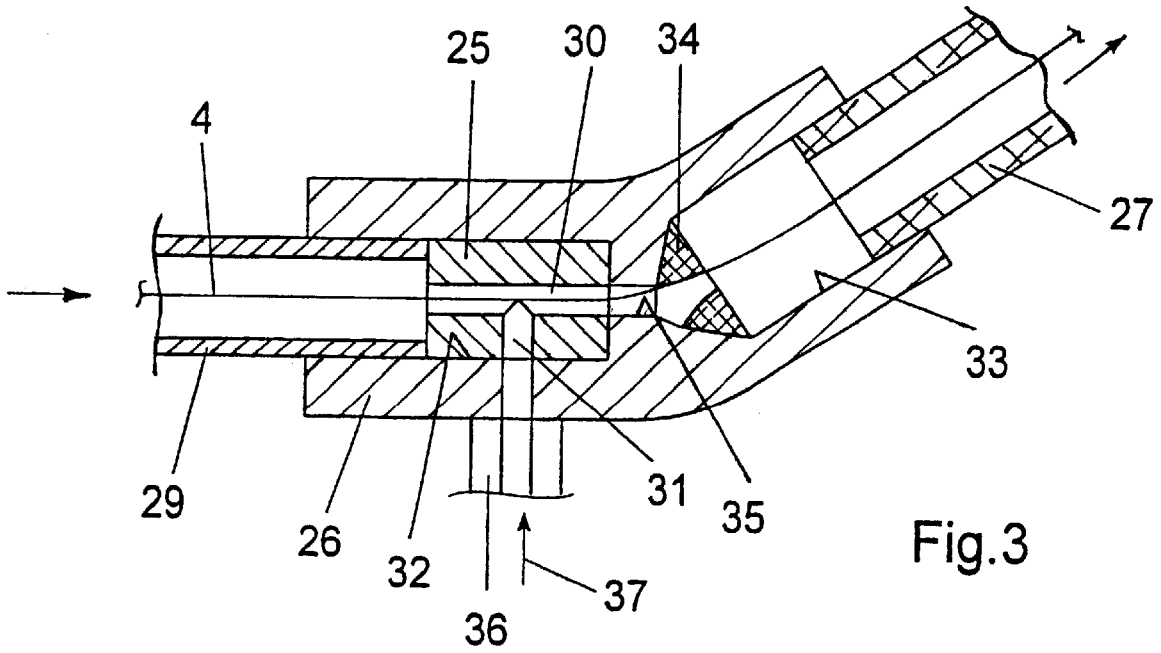

FIG. 3 shows diagrammatically a counter-twist device directly at the outlet of the second heating device 16. The counter-twist device is formed in this case by a vortexing nozzle 25. The vortexing nozzle 25 is disposed at the end of a heating tube 29. The heating tube 29 is heated up within the second heating device 16 by means of a heating jacket (not shown here). The vortexing nozzle 25 comprises a thread channel 30. The thread channel 30 lies in the axis of the heating tube 29.

Figure 4:
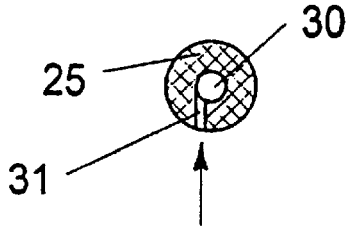

As shown in FIG. 4, an air duct 31 issues tangentially in the thread channel 30. There is fed through the air duct 31 preferably compressed air, which flows into the thread channel 30. The tangentially in-flowing air current produces a counter-twist in the thread 4.

As shown in FIG. 3, the vortexing nozzle 25 is secured to the outlet of the heater tube 29 by means of an adaptor 26. For this the vortexing nozzle 25 is fit into a receiving bore 32 of the adaptor 26. The end of the heater tube 29 likewise projects into the receiving bore 32 of the adaptor 26. The vortexing nozzle, as well as the end of the heater tube 29, is secured by a shoulder formed at the end of the receiving bore 32. A further receiving bore 33 is introduced on the opposite side of the adaptor 26. The axes of the receiving bores 32 and 33 form an angle of <180° here. Within the adaptor the receiving bores 32 and 33 are connected to one another by a smaller bore 35. The receiving bore 33 serves to receive a compensating tube 27. At the end of the receiving bore 33 there is disposed within the adapter 26 a thread guide 34. At the thread guide 34 the thread is deflected out of the straight thread path of the vortexing nozzle 25.

On the adaptor 26 there is arranged a compressed air connection 36, which is connected to the air duct 31. The air current 37 is fed to the vortexing nozzle 25 via the compressed air connection. The arrangement shown in FIG. 3 possesses the advantage that the counter-twist is produced in the thread directly at the heater outlet. Moreover, because of the use of a vortexing nozzle an opening of the filaments of the thread occurs, so that the crimp treatment in the heating device is improved.

Figure 5:
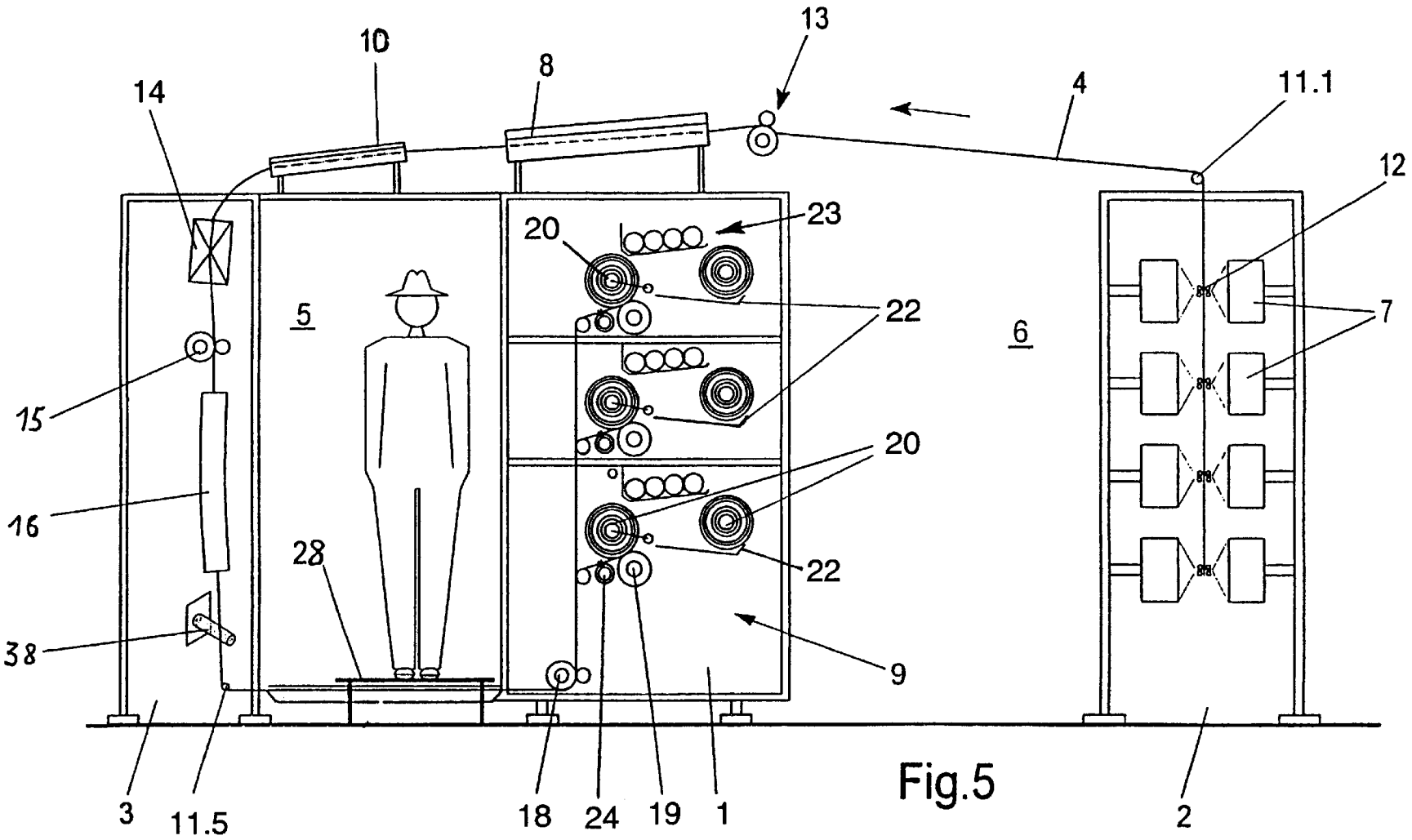

FIG. 5 shows a further embodiment of a false twist texturing machine. The false twist texturing machine likewise consists of a creeling frame 2, a process frame 3 and a winding frame 1. A control aisle 5 is formed between the process frame 3 and the winding frame 1. On the side of the winding frame 1 which lies opposite the control aisle 5 is disposed, at a distance from the winding frame 1, the creeling frame 2. A doffing aisle 6 is thus formed between the winding frame 1 and the creeling frame 2.

In the winding frame are disposed one above the other three winding devices 9, which each pertain to a handling point of the machine. In each handling point the thread 4 is drawn off from a feeding spool 7 disposed in the creeling frame 2 via a top thread guide 12 by a first delivery device 13. The thread 4 is then conveyed by the first delivery device 13 into the false twist zone, which comprises a heating device 8, a cooling device 10 and a false twist unit 14. The thread 4 is then drawn out of the false twist zone by a second delivery device 15. A third delivery device 18 then passes the thread 4 to the winding device 9.

In the winding device 9 the thread 4 is wound onto a winding spool 20, which is driven at the periphery by a friction roll 19. Upstream of the friction roll 19 is located a traversing apparatus 24 by means of which the thread 4 is run to and fro on the winding spool 20 and wound onto the latter as a cross-wound bobbin. The winding device 9 comprises a spool store 22 which serves to receive the full spool when a full winding spool 20 has been produced on the winding device. In order to receive the full spool 20, the spindle support is pivoted and the full spool deposited on a take-off track. The take-off track is part of the spool store 22. The full spool 20 waits on the take-off track until it is removed. Consequently the take-off track of the spool store 22 is arranged on the side of the winding frame 1 which is adjacent to the doffing aisle 6 and faces away from the control aisle 5. The doffing aisle 6 extends along the winding frame 1 and is formed between the creeling frame 2 and the winding frame 1. It serves to remove the full spools which are waiting on the spool store 22. There is further assigned to each winding device 9 a tube feed device 23, which will not be described in detail. A tube store is involved, on which several empty tubes are stored temporarily When a winding device 9 produces a full spool on the spindle support and the full spool has been deposited on the spool store, an empty tube is fed to the spindle support in each case and secured to it.

The thread 4 is drawn out of the false twist zone by the second delivery device 15 and conveyed through the second heating device 16 by means of the third delivery device 18. Between the third delivery device 18 and the second heating device 16 there is imparted to the thread 4 by a counter-twist apparatus 38 a counter-twist which is opposite to a twist produced by the false twist imparter. Downstream of the counter-twist apparatus 38 the thread 4 is substantially twist-free.

Figure 6:
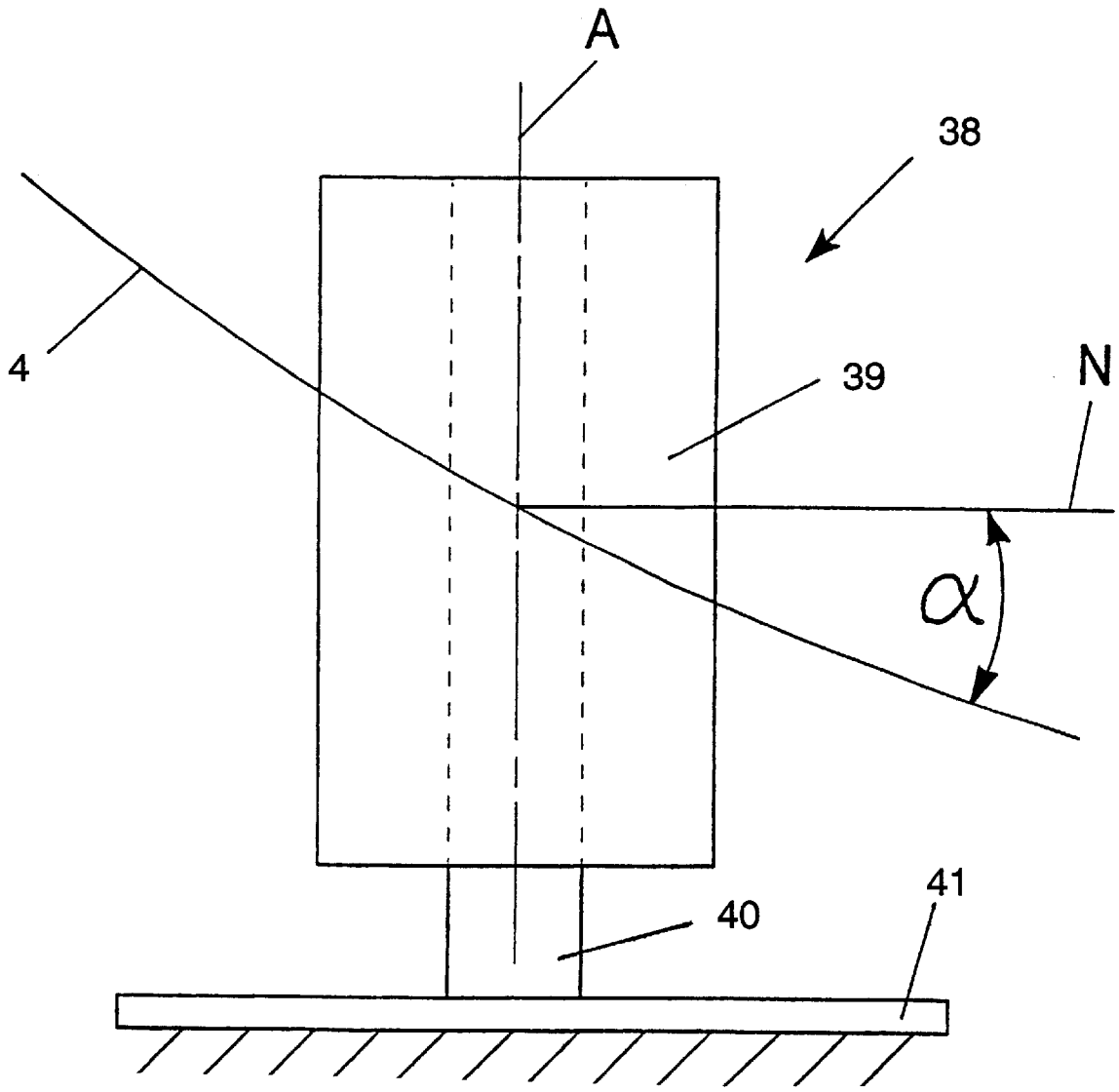

FIG. 6 shows a further embodiment of a counter-twist apparatus. The counter-twist apparatus 38 comprises a cylindrically shaped body 39. The cylindrically shaped body 39 is arranged so as to capable of rotating on an axle 40. The axle 40 is connected to a fixing plate 41 which is secured to the frame, and defines a central axis A.

The thread 4 is drawn off via the rotating body 39 of the counter-twist apparatus in such a way that the thread 4 is substantially twist-free after the counter-twist apparatus 39. This is achieved by the counter-twist apparatus imparting to the thread 4 a twist which is opposite to a twist produced by the false twist imparter 14. The thread 4 is for this passed via the body 39 at an angle $\alpha$. The angle $\alpha$ enclosed by the thread 4 and a normal N lying perpendicular on an axis A of the body 39 is in this case smaller than 90°.

The direction of the angle $\alpha$ is modifiable, so that a counter-twist can be produced for different directions of rotation of the thread. The body 39 can also be driven by a motor. The body 39 is preferably of cylindrical construction. It can be rotationally symmetrical.

What is claimed is:

1. A yarn false twist texturing machine for texturing a multifilament synthetic yarn comprising a feeding spool, a first delivery device, a first heating device, a cooling device, a false twist unit, a second delivery device, a second heating device, a third delivery device, and a winding device serially arranged along a yarn path of travel, and a yarn counter-twist device positioned between the second heating device and the third delivery device for imparting twist to the yarn in a direction opposite to that imparted by the false twist unit and such that the counter-twist device and the second heating device are linearly aligned and the yarn runs in a straight yarn path therebetween, and so as to produce an essentially twist-free yarn, said counter-twist device comprising a vortexing nozzle which is detachably connected to the second heating device by means of an adapter and includes a yarn channel and an air duct communicating tangentially with the yarn channel for passing an air current tangentially into the yarn channel and substantially at right angles to the yarn path through the yarn channel, and wherein the second heating device comprises a heating tube and wherein the yarn channel of the vortexing nozzle is coaxially aligned with the heating tube.

2. The yarn false twist texturing machine according to claim 1 wherein the counter-twist device is disposed directly adjacent an outlet end of the second heating device.

3. The yarn false twist texturing machine according to claim 1 wherein the adapter is connected on its end opposite the second heating device to a compensating tube so that the yarn can run from the vortexing nozzle into the compensating tube.

* * * * *